United States Patent [19]

Wischusen, III

[11] 4,416,412

[45] Nov. 22, 1983

[54] COLLAPSIBLE CARTON WITH INTERIOR PARTITIONS

[75] Inventor: Henry Wischusen, III, Lilburn, Ga.

[73] Assignee: Rock-Tenn Company, Norcross, Ga.

[21] Appl. No.: 397,660

[22] Filed: Jul. 12, 1982

[51] Int. Cl.[3] ..... B65D 5/36; B65D 5/48

[52] U.S. Cl. ..... 229/41 R; 229/27

[58] Field of Search ..... 229/41 R, 41 B, 27, 229/15

[56] References Cited

U.S. PATENT DOCUMENTS

| | | | |
|---|---|---|---|
| 2,611,529 | 4/1969 | Currivan . | |
| 3,047,204 | 7/1962 | Walowicz | 229/41 R |
| 3,302,847 | 2/1967 | Hennessey | 229/27 |
| 3,563,449 | 2/1971 | Forbes . | |
| 3,625,411 | 12/1971 | Cote | 229/27 |
| 3,680,687 | 8/1972 | D'Alessio | 229/27 |
| 3,682,297 | 8/1972 | Austin . | |
| 3,804,321 | 4/1974 | Forbes | 229/27 |
| 4,134,495 | 1/1979 | Friedman | 229/27 |
| 4,260,059 | 4/1981 | Roccaforte . | |
| 4,294,397 | 10/1981 | Kohler . | |

*Primary Examiner*—Herbert F. Ross

*Attorney, Agent, or Firm*—Jones & Askew

[57] ABSTRACT

A paperboard carton and a blank for forming same, including a collapsible interior partition and locking means therefor. The carton also includes an interior biasing flap formed in the blank in a novel configuration.

11 Claims, 4 Drawing Figures

COLLAPSIBLE CARTON WITH INTERIOR PARTITIONS

TECHNICAL FIELD

The present invention relates to paperboard containers formed from appropriately cut and scored flat blanks, and more particularly relates to a carton which includes partitions for retaining an article in a central chamber and a biasing flap within the chamber for cushioning and retaining the article in a desired position.

BACKGROUND ART

It is often necessary to transport solid articles, some of irregular shape, which require some protection, but are not so fragile as to require complete immersion in packing material. According to one well-known technique, such articles can be packed in paperboard cartons having partitions which hold the article away front the ends of the carton. One such carton is shown in U.S. Pat. No. 3,682,297, which is designed for containing tape cassettes. In the carton shown in such patent, transverse for partitions can be moved between positions opening or blocking a sleeve defined by the walls of the carton for receiving the product. In order to hold the partition in an erected position blocking the sleeve, the partition interlocks with a notch in the tuck flap of the end closure of the carton.

Other prior cartons having transverse partitions include U.S. Pat. No. 3,563,449 and U.S. Pat. No. 4,294,397. No known carton discloses a means for locking a collapsible partition in an erected position in a carton which does not include a tuck flap end closure.

In other prior art cartons, such as those disclosed in U.S. Pat. No. 2,611,529 and U.S. Pat. No. 4,260,059, flaps extending into the interior of the carton have been used to cushion articles inserted into the carton. A disadvantage of such prior cartons is that such flaps are provided by adding additional paperboard material to the blank extending away from the remainder of the carton.

SUMMARY OF THE INVENTION

The present invention provides a novel paperboard carton, and paperboard blank from which the carton is formed, having a collapsible transverse partition that is lockable in the erected position without interlocking with an end closure. The carton also includes an internal biasing flap positioned with respect to an interior partition assembly so as not to increase the size of the blank required for forming the carton.

Generally described, a carton embodying the present invention comprises foldably interconnected side panels defining a carton chamber having an open end, a partition panel extending across the chamber and foldably connected to two glue panels affixed to opposing side panels of the carton, the partition panel being located adjacent to the open end of the carton chamber, a fold-away panel defined in one of the glue panels, the fold-away panel being foldably connected to the partition panel and foldable away from the remainder of the glue panel to permit the partition panel to collapse from an erect position blocking the open end of the carton chamber to a collapsed position opening the carton chamber for the insertion of an article, and a locking flap foldably connected to the partition panel and extending outwardly therefrom, whereby the partition panel is prevented from collapsing when the locking flap is folded substantially perpendicular thereto. The partition panel and locking flap can include a colinear longitudinal score to facilitate the collapsing motion thereof when the locking flap is not in a locking position. The carton can also include end flaps which can assist in holding the locking flap in its locking position perpendicular to the partition panel without interlocking with the locking flap.

A flat blank of paperboard embodying the present invention for forming a carton comprises at least three side wall panels foldably connected along parallel longitudinal score lines, and an interior partition assembly comprising a first glue panel foldably connected to one of the side wall panels along a longitudinal score line, the first glue panel defining a fold-away portion thereof foldably connected to the remainder of the first glue panel by a longitudinal score line parallel to the score line connecting the first glue panel to the side wall panel, a partition panel foldably connected along a longitudinal score line to the fold-away portion of the first glue panel, a second glue panel foldably connected along a longitudinal score line to the end of the partition panel opposite the first glue panel, and a locking flap foldably connected along a transverse score line to the partition panel, the locking flap being foldable to a position perpendicular to the partition panel to selectively prevent the fold-away portion of the first glue panel from collapsing away from the first glue panel when the carton is erected. The blank can also include a second partition panel connecting the first and second glue panels at a position spaced apart from the first partition panel to define a space between the partition panels and the glue panels, and a biasing flap extending from one of the glue panels into the space.

A blank according to the invention can also be generally described as comprising at least three side wall panels foldably connected along parallel longitudinal score lines, and an interior partition assembly comprising a first glue panel foldably connected to one of the side wall panels along the longitudinal score line, the first glue panel defining a fold-away portion thereof foldably connected to the remainder of the first glue panel by a longitudinal score line parallel to the score line connecting the first glue panel to the side wall panel, a first partition panel foldably connected along a longitudinal score line to the first glue panel, a second partition panel foldably connected along a longitudinal score line to the first glue panel spaced apart from the first partition panel, a second glue panel foldably connected along longitudinal score lines to the ends of the partition panels opposite the first glue panel, and a biasing flap extending from one of the glue panels toward the other of the glue panels between the partition panels.

Thus, it is an object of the present invention to provide an improved interior partition assembly for a paperboard carton.

It is a further object of the present invention to provide a partition for the interior of a paperboard carton collapsible to permit insertion of an article into the carton and erectable and lockable in a position retaining the article in the carton.

It is a further object of the present invention to provide a paperboard blank for forming a carton having such an interior partition assembly.

It is a further object of the present invention to provide a blank for forming a paperboard carton having an interior partition assembly and an interior biasing flap, without increasing the size of the blank to provide the biasing flap.

Other objects, features and advantages of the present invention will become apparent upon reading the following detailed description of embodiments of the invention, when taken in conjunction with the drawing and the appended claims.

DETAILED DESCRIPTION

Figure 1:
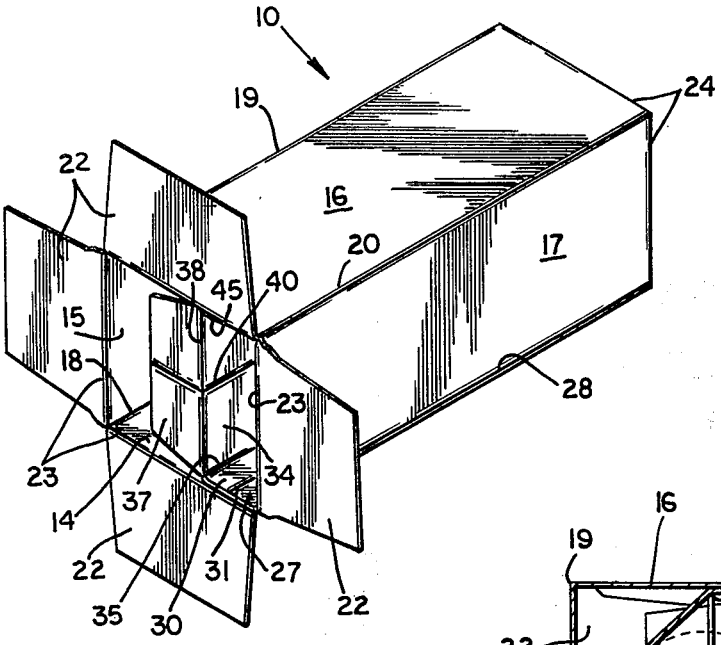
FIG. 1 is a perspective view of a paperboard carton embodying the present invention, showing the collapsible partition in its erected and locked position.

Referring now in more detail to the drawing, in which like numerals represent like parts throughout the several views, FIG. 1 shows a paperboard carton 10 embodying the present invention. The carton 10 is formed from a paperboard blank 11 shown in plan view in FIG. 2. The carton 10 includes four similar side wall panels 14–17, which, in the embodiment shown, extend longitudinally to define an elongate carton chamber. The side panels 14–17 are foldably connected by longitudinal score lines 18–20. An end flap 22 is foldably connected to each end of each of the side wall panels 14–17 by transverse score lines 23 and 24 which define the opposite transverse edges of the side wall panels. As shown, the end flaps 22 are conventional flat, one-panel flaps which would require glue to secure them in overlapping relationship across the end of the carton chamber. It will be understood by those skilled in the art that other end closure means could be provided.

Figure 2:
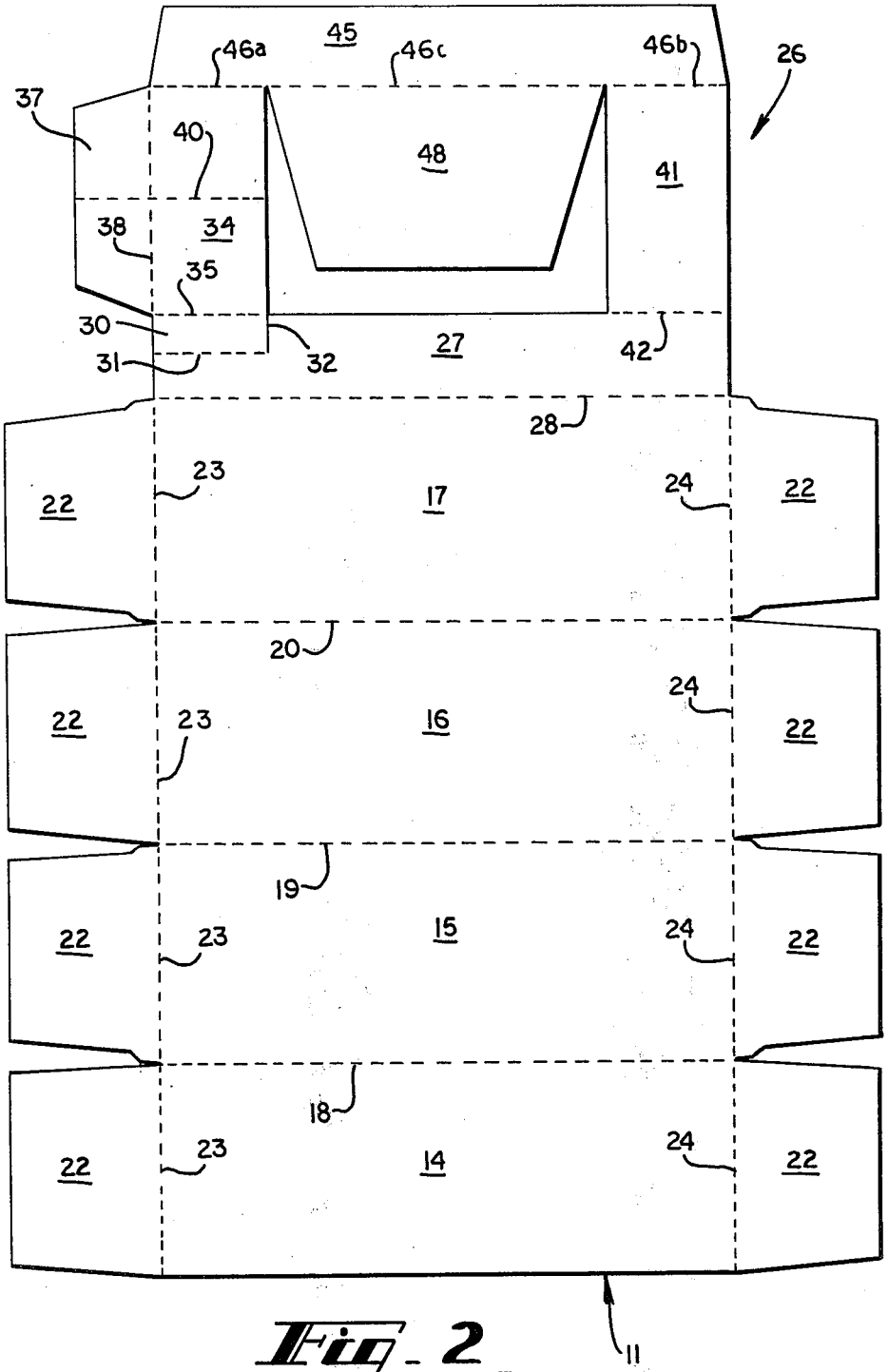
FIG. 2 is a plan view of a paperboard blank for forming the carton shown in FIG. 1.

An interior assembly 26 extends transversely from the side wall panel 17, as best seen in FIG. 2. The interior assembly 26 includes a first glue panel 27 foldably connected to the side wall panel 17 by a longitudinal score line 28. The first glue panel 27 includes a fold-away portion 30 thereof, defined by a longitudinal score line 31 extending from an end of the glue panel 27 intermediate the width of the glue panel 27 and for a portion of its length to meet a transverse cut 32 which extends from the score line 31 to the longitudinal edge of the glue panel 27 opposite the score line 28. When glue is applied to the glue panel 27, as will be described hereinafter, glue is not applied to the foldaway portion 30.

The interior assembly 26 further includes a collapsible partition panel 34 foldably connected to the fold-away portion 30 by a longitudinal score line 35 that is colinear with the longitudinal edge of the glue panel 27 opposite the score line 28. The collapsible partition panel 34 extends transversely from the score line 35 in a direction away from the side wall panels for a distance approximately equal to the width of the side wall panels 14–17. A locking flap 37 is foldably connected to the partition panel 34 by a score line 38 which is preferably a "jump cut" score. The score line 38 is preferably approximately colinear with the transverse score line 23 which defines one end of the carton chamber. The locking flap 37 extends longitudinally outwardly from the score line 38 and can have beveled corners as shown in FIG. 2. A longitudinal score line 40 extends colinearly across both the collapsible partition panel 34 and the locking flap 37 intermediate their widths. The score 40 facilitates the collapsing of the partition panel 34 and the locking flap 37 as will be described below.

A second partition panel 41 is foldably connected to the first glue panel 27 along a longitudinal score line 42 located in spaced apart relation from the collapsible partition panel 34. Preferably, the panel 41 is located adjacent to the opposite end of the carton chamber, and extends transversely from the glue panel 27 the same distance as the panel 34. A second glue panel 45 extends longitudinally to interconnect the panels 34 and 41. The glue panel 45 is foldably connected to the extending end of the collapsible partition panel 34 along a longitudinal score line **46*a* and is foldably attached to the partition panel 41 along a colinear longitudinal score line 46*b***.

A biasing flap 48 extends from the second glue panel 45 back toward the side wall panels 14–17 into the space defined by the glue panels 27 and 45 and the partition panels 34 and 41. The biasing flap 48 is foldably connected to the glue panel 45 by a longitudinal score line **46*c* that is colinear with the score lines 46*a* and 46*b*. The transverse edges of the biasing flap 48 can be beveled to angle inwardly from the corners defined between the second glue panel 45 and the partition panels 34 and 41. The transverse width of the biasing flap 48 must be longer than the difference between the width of one of the side wall panels 14–17 and the width of the glue panel 45, so that the extending longitudinal edge of the biasing flap 48** does not catch on one of the longitudinal score lines separating the side wall panels when the carton is erected in the manner described below.

In order to assemble the carton 10 from the blank 11, the outward portions of the interior assembly 26 are folded about the scores 35 and 42 over panels 27 and 17. Glue is next applied to the exposed surface of glue panel 45, and to the exposed surface of glue panel 27, excluding the fold-away portion 30. Next, panels 14, 15 and 16 are folded about score 20, adhering panel 16 to glue panel 45. Finally, panel 14 is folded about score 18 to adhere the outer edge of panel 14 to the glue panel 27. In this assembled form, the carton is in a flat form suitable for shipping, and the biasing flap 48 lies across the longitudinal score 20 so as not to be caught in the score when the carton is erected.

Figure 4:
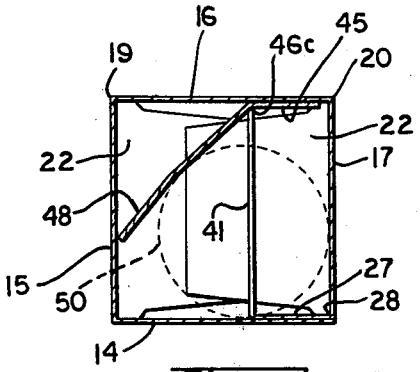
FIG. 4 is a transverse cross sectional view of the carton of FIGS. 1 and 3 taken along line 4—4 of FIG. 3.
Figure 3:
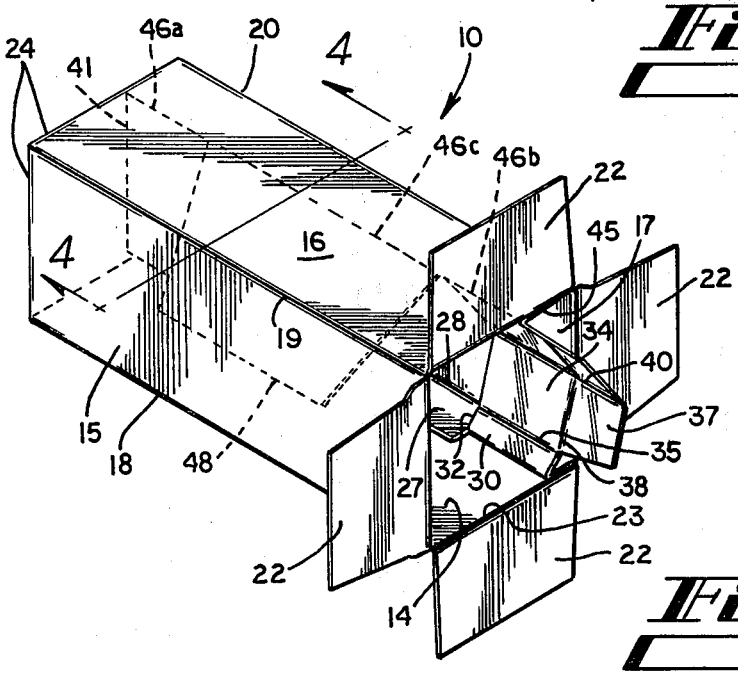
FIG. 3 is a perspective view of the carton of FIG. 1, showing the collapsible partition and locking flap in their collapsible position.

In order to erect the carton into the form shown in FIGS. 1 and 2, the longitudinal corners of the flat assembly are merely urged toward one another. This causes the carton to assume a rectangular configuration, as shown in FIG. 1, with the partition panels 34 and 41 extending transversely across the carton chamber. When erected, the biasing flap 48 assumes a position across the corner of the carton chamber, as shown in FIG. 4. In order to open the end of the carton chamber for the insertion of an article 50 (shown in dotted lines in FIG. 4), pressure is exerted at the location of the score line 40 on the collapsible partition panel 34 and the locking flap 37, toward the side wall panel 17. This causes the fold-away portion 30 of the glue panel 27 to fold away from the remainder of the glue panel 27 and causes the panels 30, 34 and 37 to assume a collapsed configuration as shown in FIG. 3. When the article is inserted into the carton chamber beyond the collapsible partition panel 34, it engages the biasing flap 48 and deforms the biasing flap 48 as necessary. The biasing flap 48 thereby exerts pressure on the article in order to cushion it within the carton chamber and to assist in maintaining the article in a particular position. When fully inserted, the article also engages the partition panel 41.

To place the collapsible partition panel 34 in its erected configuration, as shown in FIG. 1, pressure is simply exerted on the panel in the opposite direction from that described above in order to collapse the panel. Upon the application of such pressure, the fold-away portion 30 assumes its original coplanar relationship with the remainder of the glue panel 27, and the collapsible partition panel 34 once again extends transversely across the carton chamber parallel to the side wall panels 15 and 17. In its erected position, the partition panel 34 cooperates with the partition panel 41 to maintain the article in a central longitudinal position within the carton chamber.

In order to block the collapsible partition panel 34 against inadvertent collapse which might permit the article to fall out of the carton, the locking flap 37 is folded about the score line 38 to a position approximately perpendicular to the plane of the partition panel 34. Since the locking flap 37 cannot bend or fold about an axis perpendicular to the plane of the flap, the locking flap 37 will, in the position described, prevent any bending of the partition panel 34 about the score line 40, and therefore will prevent the foldaway portion 30 from being moved into the position shown in FIG. 3.

It will also be noted that any means for maintaining the locking flap 37 in a position perpendicular to the panel 34 will suffice to maintain the locked position of the collapsible panel. Therefore, it is not necessary to provide an end closure which interlocks with the locking flap or partition panel. In particular, if the end flaps 22 are folded across the end of the carton chamber, they will maintain the locked position of the locking flap 37. Alternately, in an embodiment wherein the carton 10 does not include end flaps, the locked position of the locking flap 37 can be maintained by stacking the cartons rotated 90° with respect to one another, by staggered stacking of a plurality of the cartons 10 within a larger packing carton, or by the top and bottom of a larger packing carton. In such a case, the mere presence of an edge of one of the side wall panels adjacent to the locking flap 37 or of an adjacent horizontal member would maintain the locking flap in its folded position perpendicular to the collapsible partition panel 34.

When it is desired to remove the article 50 from within the carton chamber, the locking flap 37 is folded back to a position approximately coplanar with the collapsible partition panel 34. Then, the panel 34 and flap 37 can be collapsed to the position shown in FIG. 3 in the manner described above for insertion of the article.

It should be noted that the configuration of the blank 11 shown in FIG. 2 is particularly conservative of paperboard material, since the biasing flap 48 extends into a space defined between the partition panels and the glue panels, whereas in prior cartons including biasing flaps, such biasing flaps extended outwardly away from the remainder of the carton and required a larger area of paperboard. It should further be noted that in the blank 11 shown in FIG. 2, it is not necessary to provide a full length glue panel 27, since alternatively the section of the glue panel 27 between the partition panels 34 and 41 could be eliminated.

It is also possible to modify the carton shown in the drawing by providing a further fold-away portion of the glue panel 27 in order to make the partition panel 41 a collapsible partition panel having a structure similar to the panel 34. This would permit insertion or removal of the article from either end of the carton. Also a fold-away portion for the partition panels 34 or 41 could be provided in the glue panel 45, such that both ends of the partition panel would collapse to more fully open the carton chamber. Furthermore, if it was not desired to provide a biasing flap within the carton, the biasing flap 48 and the section of the second glue panel 45 between the partition panels 34 and 41 could be eliminated.

While this invention has been described in detail with reference to a preferred embodiment thereof, it will be understood that variations and modifications can be effected within the spirit and scope of the invention as described hereinbefore and as defined in the appended claims.

I claim:

1. A carton formed from a flat blank of paparboard or the like, comprising:

foldably interconnected side panels defining a carton chamber having an open end;

partition panel means extending across said chamber and foldably connected to two glue panels affixed to opposing side panels of said carton, said partition panel means being located adjacent to said open end of said carton chamber;

fold-away panel means defined in one of said glue panels, said fold-away panel means being foldably connected to said partition panel means and foldable away from the remainder of said glue panel to permit said partition panel means to collapse from an erect position blocking said open end of said carton chamber to a collapsed position opening said carton chamber for the insertion of an article; and locking flap means foldably connected to said partition panel means and extending outwardly therefrom, whereby said partition panel means is prevented from collapsing when said locking flap means is folded substantially perpendicular thereto.

2. The carton of claim 1, further comprising end flap means for closing said open end of said carton chamber, said end flap means selectively holding said locking flap means in approximately perpendicular relation to said partition panel means in said erect position to prevent collapse thereof.

3. The carton of claim 1, wherein both of said glue panels define fold-away panel means foldably attached to opposite ends of said partition panel means.

4. The carton of claim 1, further comprising biasing flap means extending from one of said glue flaps into said carton chamber.

5. The carton of claim 1, wherein said partition panel means is a first partition panel means, and further comprising a second partition panel means extending across said chamber between said glue panels, said second partition panel means being spaced apart from said partition panel means.

6. A flat blank of paperboard or the like for forming a carton, said blank comprising:

at least three side wall panels foldably connected along parallel longitudinal score lines; and interior partition means comprising:

a first glue panel foldably connected to one of said side wall panels along a longitudinal score line, said first glue panel defining a fold-away portion thereof, foldably connected to the remainder of said first glue panel by a longitudinal score line parallel to said score line connecting said first glue panel to said side wall panel;

a partition panel foldably connected along a longitudinal score line to said fold-away portion;

a second glue panel foldably connected along a longitudinal score line to the end of said partition panel opposite said first glue panel; and a locking flap foldably connected along a transverse score line to said partition panel, said locking flap being foldable to a position perpendicular to said partition panel to selectively prevent said fold-away portion from collapsing away from said first glue panel when said carton is erected.

7. The blank of claim 6, further comprising a second partition panel connecting said first and second glue panels at a position spaced apart from said first partition panel to define a space between said partition panels and said glue panels; and a biasing flap extending from one of said glue panels into said space.

8. The blank of claim 7, wherein said biasing flap extends into said space a distance greater than the difference between the transverse dimension of said side wall panels and said glue panel to which said biasing flap is attached.

9. The blank of claim 6, wherein said partition panel and said locking flap include a colinear longitudinal score line intermediate the ends thereof.

10. The blank of claim 6, further comprising end panels foldably connected along transverse score lines to opposite ends of said side wall panels.

11. A flat blank of paperboard or the like for forming a carton, said blank comprising:

at least three side wall panels foldably connected along parallel longitudinal score lines;

interior partition means comprising:

a first glue panel foldably connected to one of said side wall panels along a longitudinal score line, said first glue panel defining a fold-away portion thereof, foldably connected to the remainder of said first glue panel by a longitudinal score line parallel to said score line connecting said first glue panel to said side wall panel;

a first partition panel foldably connected along a longitudinal score line to said first glue panel;

a second partition panel foldably connected along a longitudinal score line to said first glue panel spaced apart from said first partition panel;

a second glue panel foldably connected along longitudinal score lines to the ends of said partition panels opposite said first glue panel; and a biasing flap extending from one of said glue panels toward the other of said glue panels between said partition panels.

* * * * *